US007243870B2

(12) United States Patent
Pook et al.

(10) Patent No.: US 7,243,870 B2
(45) Date of Patent: Jul. 17, 2007

(54) PORTABLE STUDIO HOIST

(75) Inventors: Barbara S. Pook, Sunnyside, NY (US); Anthony J. Diemont, Crompond, NY (US); Theodore G. Ohl, Larchmont, NY (US)

(73) Assignee: Pook Diemont & Ohl, Inc., Bronx, NY (US)

( * ) Notice: Subject to any disclaimer, the term of this patent is extended or adjusted under 35 U.S.C. 154(b) by 76 days.

(21) Appl. No.: 11/098,511

(22) Filed: Apr. 4, 2005

(65) Prior Publication Data

US 2005/0231148 A1 Oct. 20, 2005

Related U.S. Application Data

(60) Provisional application No. 60/559,208, filed on Apr. 2, 2004.

(51) Int. Cl.
*B66D 1/26* (2006.01)

(52) U.S. Cl. ..... 242/278

(58) Field of Classification Search ..... 254/278, 254/279, 290, 292, 294, 316, 383
See application file for complete search history.

(56) References Cited

U.S. PATENT DOCUMENTS

| | | | | |
|---|---|---|---|---|
| 410,507 | A * | 9/1889 | Fain | 254/278 |
| 2,020,306 | A * | 11/1935 | Fitch | 294/81.3 |
| 2,626,375 | A * | 1/1953 | Fischer | 318/67 |
| 2,720,327 | A * | 10/1955 | Bain | 414/624 |
| 2,811,262 | A * | 10/1957 | Schaitberger | 212/331 |
| 3,809,422 | A * | 5/1974 | Schlough | 294/74 |
| 4,438,903 | A * | 3/1984 | Gagnon et al. | 254/269 |
| 4,662,628 | A * | 5/1987 | Chatenay epouse Compagnone | 472/77 |
| 4,881,548 | A * | 11/1989 | Kramer | 607/91 |
| 5,361,565 | A * | 11/1994 | Bayer | 254/292 |
| 6,105,938 | A * | 8/2000 | Koida | 254/278 |
| 6,386,324 | B1 * | 5/2002 | Baranda et al. | 187/254 |
| 6,600,289 | B2 * | 7/2003 | George et al. | 318/727 |
| 6,601,828 | B2 * | 8/2003 | Strbuncelj et al. | 254/266 |
| 6,921,061 | B2 * | 7/2005 | Hayashi et al. | 254/373 |
| 6,957,804 | B2 * | 10/2005 | Heggestad | 254/278 |
| 6,969,049 | B2 * | 11/2005 | Bilcik | 254/278 |
| 6,991,064 | B2 * | 1/2006 | Ehrenleitner | 182/141 |

* cited by examiner

*Primary Examiner*—Emmanuel M Marcelo
(74) *Attorney, Agent, or Firm*—Aufrichtig Stein & Aufrichtig, P.C.; Peter D. Aufrichtig; Reine H. Glanz

(57) ABSTRACT

A portable studio hoist which can be positioned and secured in a studio pipe grid or other structural setting without the need for hard wired power supplies or fixed attachments. The portable studio hoist is designed to operate on standard single phase 120 volt power and includes a motor mounted to a support bar with a dual cable system for supporting, raising and lowering a batten to which the load is secured. The portable studio hoist allows for easy movement as needed within a studio environment and attachment where needed with provisions for variably orientated attachment relative to the pipe grid. A series of portable studio hoists can be secured around the studio and then controlled remotely from a single location by way of the use of control hubs, to which a series of portable studio hoists are connected, and a selector control station connected to each control hub with a pendant to operate the hoists.

23 Claims, 6 Drawing Sheets

PORTABLE STUDIO HOIST

This application claims the priority of provisional application Ser. No. 60/559,208 filed in the United States Patent and Trademark Office on Apr. 2, 2004.

BACKGROUND OF THE INVENTION

The invention is generally directed to a portable studio hoist for use in raising and lowering lighting and other items from the pipe grids used in television studios, which are generally suspended from the building structure. The portable studio hoist is utilized to move studio lighting fixtures, which are affixed to the pipe grid vertically between the floor and the pipe grid. It may also be used to move lighting fixtures and other loads in other settings secured to appropriate fixed structural locations Generally, existing hoists in theater and studio applications are intended for permanent installation, and typically, because of their size, weight and power requirements, must be installed as part of the building construction project. The hoists are affixed to the building's structural steel and permanently wired with three-phase power and a hard wired control circuitry, usually utilizing conduit wiring to meet building codes and electrical codes for permanent installations. As a result, the location of moving pipes must, therefore, be anticipated in the design process when a theater or studio is being built.

However, most U.S. television studios are equipped with pipe grids. These are static pipe structures suspended from the building structure. In turn, studio lighting fixtures are affixed to this grid. The fixtures are frequently moved and adjusted, requiring operators to climb ladders for access. Generally, standard hoists can only be added to the building steel or with the addition of structural steel because the pipe grid does not have sufficient weight bearing capacity to support the weight of these hoists, and lifted weight, which generally run about 750 or more pounds.

The pipe grids are typically equipped with lighting power distribution strips carrying power to all locations on the grid. This permits optimum flexibility for the lighting. The power, however, is single-phase 120 VAC, which is sufficient for the lighting. If a typical hoist is added to this system, three-phase power must be run to that location, which becomes a fixed location for that hoist. Accordingly, there is a need for an improved hoist that can carry a modest payload, up to about 300 pounds, and could be quickly moved anywhere on a grid and be quickly provided with existing power. That need is typically only identified by the studio operators after the studio has been built and in use for a time and, thus, there is also a need for the portable hoist to be of a sort which can be brought to a site when and as needed or be rented from a lighting rental house, together with studio lighting fixtures. It is also necessary to develop a portable hoist system which can be moved around the grid to areas where workers are either adding, removing or modifying studio lighting fixtures in connection with a production.

SUMMARY OF THE INVENTION

The invention is generally directed to a portable studio hoist, which includes a mechanism for removably connecting the portable studio hoist to the pipe grid structure used in television and theatrical studios and performance venues, which allows studio lighting fixtures to be raised and lowered from the grid to different operating positions and the floor safely and without the need for dedicated wiring or structural modifications to the theater and studio to support the hoist.

The invention is also directed to a portable hoist incorporating a removable shaft associated with the motor so that the end user can modify the shaft depending upon its specific application without affecting the performance or operation of the portable hoist. The portable hoist can also be controlled remotely via a light-weight, low power and voltage remote, either directly or through a remote control center into which one or more portable hoists at a site may be controlled.

Accordingly, it is an object of the invention to provide an improved portable hoist to improve access to lighting fixtures and efficiency of broadcast studios by allowing studio lighting fixtures to be raised and lowered from the pipe grid without having to bring in special power or structural elements to the pipe grid.

It is another object of the invention is to provide an improved portable hoist for use in theater and studio applications utilizing a single-phase 120 VAC current which may be removably secured to the pipe grid wherever it is needed without the need for special tools or additional installation hardware.

Yet another object of the invention is to provide an improved portable hoist which includes a motor with a shaft that is removable and replaceable with shafts of different lengths to adapt for different batten lengths and other conditions.

Still another object of the invention is to provide an improved portable hoist in which the shaft may be replaced by the end user without affecting the operation of the hoist.

Yet still a further object of the invention is to provide an improved portable hoist which may be connected either parallel to the standard pipes of the pipe grid or at an angle to the pipe grid so as to provide enhanced flexibility of positioning of the portable hoist.

Another object of the invention is to provide a hierarchical system of connecting a series of portable hoists to a pipe grid or similar structures where the portable hoists are connected to a control hub, which in turn can be connected to a selector station and operated by use of a pendant controller.

Still yet a further object of the invention is to provide a system of connecting a series of portable hoists to a pipe grid or similar structures where the portable hoists are connected to a selector station and operated by use of a pendant controller.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
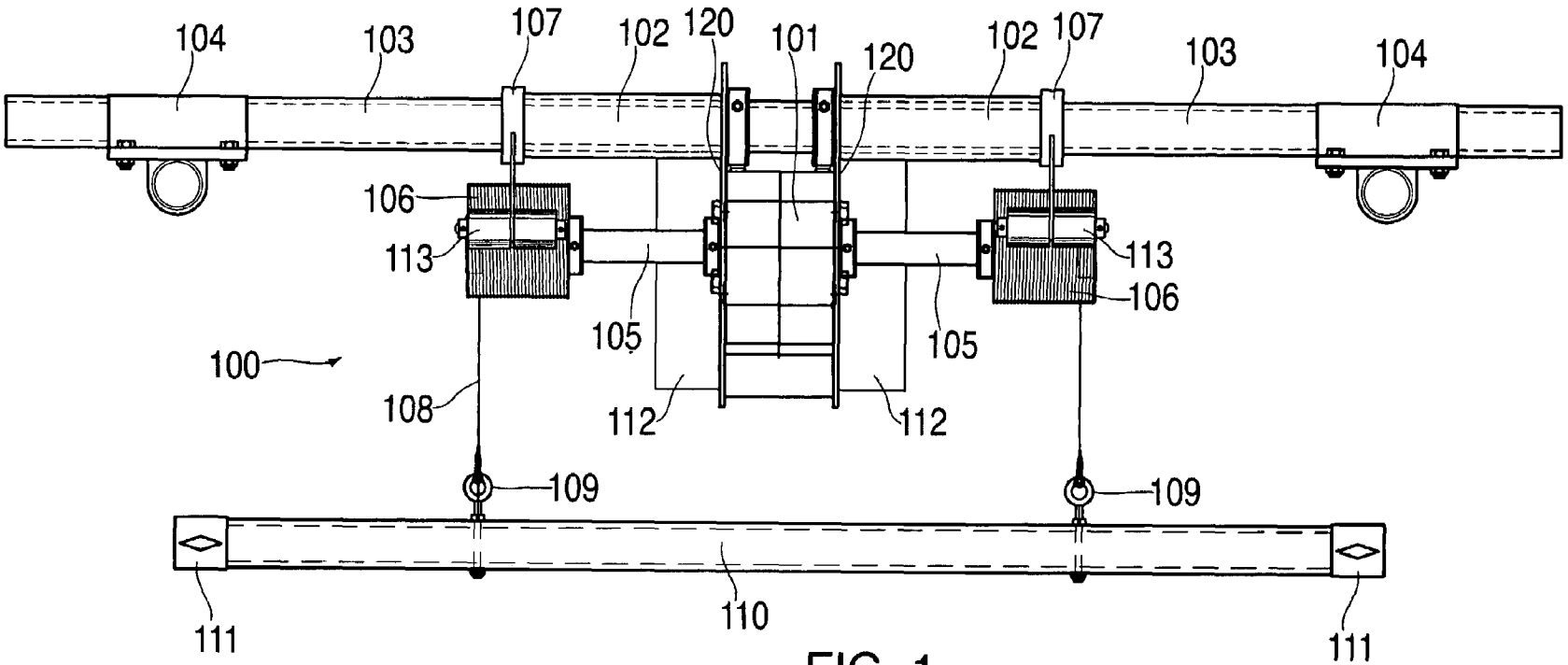
FIG. 1 is a front elevational view of a portable studio hoist constructed in accordance with a preferred embodiment of the invention.

The portable hoist was developed to address the need for a safe, low cost and portable hoist to improve access to lighting fixtures and efficiency of broadcast studios. While existing hoists in theater and studio applications are intended for permanent installation and typically must be installed as part of the building construction project, the portable studio hoist constructed in accordance with a preferred embodiment of the invention is easily movable and portable in existing studios.

In a preferred embodiment the portable studio hoist weights only about 90 pounds and can be moved by two stage hands anywhere on the pipe grid found in most U.S. television studios and many theatrical and other studio installations. The compactness, light weight and connection details are specifically designed for attachment to a standard 1½ inch schedule 40 pipe grid. The portable studio hoist can also be attached to other installations, other than a pipe grid with suitable connectors. The portable studio hoist can be attached parallel to the pipe grid members or at an angle to the pipe grid members, providing maximum lighting position control. To the extent that alternative grid sizes or arrangements are found in other applications and other countries where different standards for pipe grids or similar rigid structures for supporting lighting and the like are found, minor adaptations to the connection hardware can be made without changing the effectiveness of the portable hoist.

The portable studio hoist is an electromechanical system that is specifically designed to move scenery, lights and/or other equipment in a vertical plane. It is designed with built-in safety factors and safety features. It operates on a single-phase 120 volt power. Its single phase power requirement permits it to obtain utility power directly from the lighting distribution raceways, which permit location and relocation anywhere on the grid. In alternative environments its suitability with standard single phase utility power and without hardwired power connections allows considerable flexibility and usefulness. In a current preferred embodiment the portable studio hoist system consists of one or more compact studio portable hoists that mount to the 1½ inch schedule 40 pipe grid. Power to each portable studio hoist is via a non-dim circuit at local connector strips or local utility power. Generally, a limit of one portable studio hoist per non-dim circuit is preferred. The control to the portable studio hoist is via a control hub located at the grid and a selector station with a remote pendant located at the deck level. All connections are soft cable "plug and play" systems. The control hub is a plug-and-receptacle station for preferably eight but up to ten or more portable studio hoists. In some installations multiple control hubs are used for convenience and to minimize the distance of connecting lines between the hoists and the control hub. The selector station contains a position switch and position indicators (service, play and storage) for each portable studio hoist, an e-stop (emergency stop) button and a keyed power switch. The remote pendant includes an e-stop button, power indicator light and momentary contact "run" button. In small installations with one or two portable hoists, a powered selector station can be used without the control hub, although this does not realize some of the benefits of the control hub in the system.

The portable studio hoist's hollow shaft gearbox provides dual cable suspension for greater payload stability. This feature also allows a longer shaft to be added into the system to support batten lengths up to six feet. Wider drums providing greater travel are also an option. Drums are solid 6063 anodized aluminum for easy assembly. Additional shaft, batten and drum kits (including a T-shaped guide) are available for use. Cable retention clamps allow lift lines to be easily replaced during routine maintenance procedures, or if lift lines are damaged. The T-shaped urethane cable guide rollers keep lift lines in place on the drums. The new T-shaped urethane cable guide rollers developed in connection with the invention support the variable drum feature. Contrary to other hoists which can generally only support a change of batten length up to about 20% longer but no shorter, the portable studio hoist constructed in accordance with the invention permits the batten length to nearly double to 6 feet, and for distance between pickup points to be altered, and for the vertical travel to be increased, these alterations being simple enough to perform with factory supplied parts so they can be performed in the field by reasonably sophisticated users. Such alterations would not be possible with existing hoists.

The portable studio hoist contains the following: 1) a motor which provides the force to move the load; 2) a gear box which reduces the speed of the motor and multiplies the torque; 3) a drive shaft to transmit force to the load; 4) an AC motor drive to control voltage to the motor; 5) a series of remote pushbuttons to operate the portable studio hoist; 6) a system of limits which is factory preset but is customizable; and 7) a system of lifting cables spooled on drums that attach to a short batten to support the load.

The general specifications in accordance with the current preferred embodiment of the invention are that a 15 amp service is required for each of the portable studio hoist and control hub. The motor is, in one preferred embodiment, a one and one half horsepower motor requiring a voltage of 120 VAC, one-phase at 60 hertz. The hoist capacity is rated at 300 pounds and the portable studio hoist unit's self weight is about 90 pounds. The batten travel is up to about 25 feet with the batten speed of about 14 feet per minute in a current preferred embodiment. There are pre-sets for play/storage/service with over travel limits for up, down. The lifting cables are ⅛ inch Galvanized Aircraft Cable (GAC).

For installation and operation it is important that one first verify that the voltage to each power source for the control hub and portable studio hoist is 120 VAC. Confirm that the power is off at the non-dim circuit or circuits assigned to the control hub and portable studio hoist(s). Clamp the control hub to the pipe grid in the desired location. Mount the selector station at deck level. Mount it securely to prevent the unit from falling or dropping. Next, mount the portable studio hoist or hoists onto the pipe grid in desired locations. Clamp the portable studio hoist to the grid using load-rated hardware. Connect the control wiring by connecting the control cables from the control hub to the portable studio hoist and then connect the main control cable from the control hub to the selector station. The selector station receives its power in the main control cable from the control hub. In configurations where there is no hub the selector station is directly connected to a local utility outlet. Connect the power wiring by plugging each portable studio hoist power cable into a non-dim circuit or utility outlet with a limit of one portable studio hoist per 15A non-dim circuit. Then plug the control hub into a 15A non-dim circuit. It is important with the current equipment not to plug the equipment into dim-able circuits which might result in damage to the equipment. Next, power is turned on at the non-dim circuit or circuits assigned to the portable studio hoists, the selector station is turned on. The power indicator light will then verify that the system is energized. If it is, then the pendant is plugged into the selector station, the portable studio hoist selected and its direction of travel of the load selected using the toggle switches on the selector station. The "run" pushbutton is pushed to operate the portable studio hoist, which will run until it reaches it's limit switch. The "run" pushbutton can be released at any time to stop the portable studio hoist. The red emergency stop pushbutton is used to stop the portable studio hoist in case of emergency. Generally, it is recommended that the toggle switches be returned to the stand-by position and the selector station be turned off when the portable studio hoist is not in use.

To operate the portable studio hoist safely it is important to familiarize oneself with the operation and, prior to loading the batten or adjusting the play position limit switch, to run the batten full travel in both directions to verify that factory set limit switches are correct. It is important to not allow the batten terminations to run into the drum.

Next, evenly distribute the load on the batten and, prior to operating, check the load and look for places where the load could foul during its travel.

Setting the limits on the portable studio hoist is user accessible. The limits are set with a factory set up and down ultimate (or over-travel) limits, factory set storage (normal up) limit, service limit (normal down) and mid-range play limit. The ultimate, service and storage position limit switches protect the portable studio hoist from damage and should not be changed.

Figure 2:
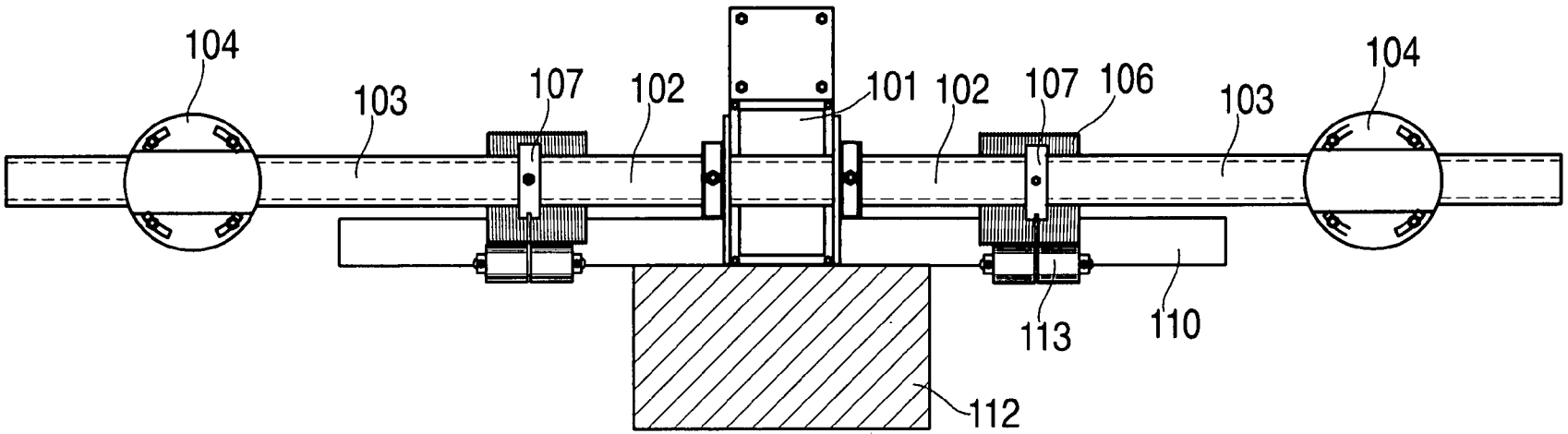
FIG. 2 is a top plan view of the portable studio hoist of FIG. 1.
Figure 3:
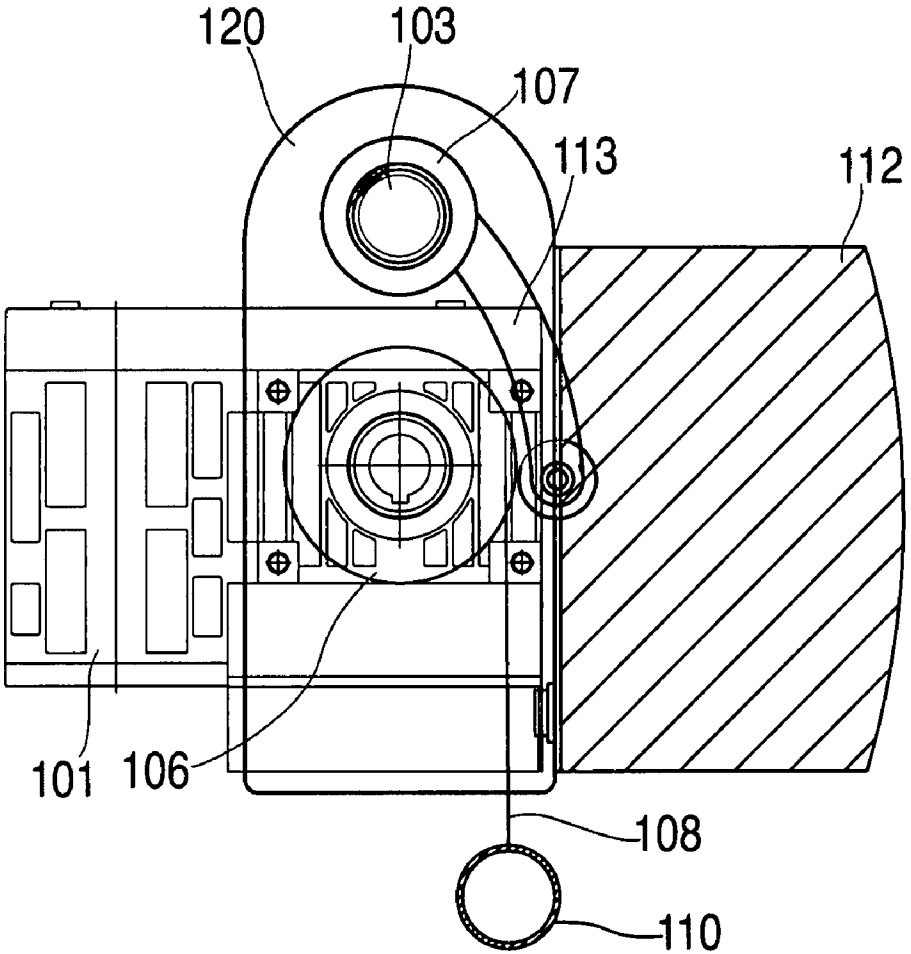
FIG. 3 is an end view of the portable studio hoist of FIG. 1.

Reference is made to FIGS. 1, 2 and 3, wherein a front elevational, top plan and end view of a portable studio hoist, generally indicated as 100, constructed in accordance with a preferred embodiment of the invention is depicted. Pipe 103 is a support pipe which supports the hoist 100 and is used to connect the hoist to the pipe grid or other structural elements. Pipe grid clamps 104 are connected to support pipe 103 on either end of support pipe 103. Adjustable pipe grid clamps 104 can have different formations depending upon the nature of the pipe grid and the way in which the portable studio hoist 100 is to be connected to the pipe grid, as described and shown below. A hollow shaft gear motor 101, supported between mounting plates 120 is also mounted on support pipe 103 by the openings in mounting plates 120 through which pipe 103 extends. Drive shaft 105 of motor 101 is connected to both drums 106, which are found on both sides of motor 101. In different embodiments, shaft 105 can be replaced with shafts of greater distance where there is a longer batten 110. Drums 106 interact with T-shaped guides 113, which include an arm and two urethane rollers, which are attached to shaft collars 107 and which guide the cables 108 as they are being rolled onto and off drums 106. Shaft collar 107 is welded to a sleeve 102 which fits over support pipe 103. The end of sleeve 102 which is not welded to shaft collar 107 rests against mounting plate 120, and shaft collar 107 is held in place by a screw or other conventional means pressing against support pipe 103. Cables 108 descend from drum 106 to batten 110 and are secured to batten 110 with standard eye bolt, locknut and shaft collars 109.

The objects to be hoisted or maintained in position by portable studio hoist 100 are secured in a traditional fashion to batten 110. Batten 110, which includes batten end caps 111, is in a first preferred embodiment, 3 feet long. However, the batten length can be adapted and increased depending upon the needs of the object, such as a studio lighting fixture which are to be affixed to it for raising and lowering. In preferred embodiments, the shaft 105 can be substituted out with a different shaft of greater length, with the drums 106 and T-shaped guides 113 on either end of shaft 105 repositioned for a wider support of a batten 110 of a greater length such as six feet.

With reference to FIG. 2, one can see that the starter cabinet 112 sits adjacent to hollow shaft gear motor 101 and provides the connection of the 120 volt power source to the motor 101. Starter cabinet 112 includes the usual control circuitry and over current protection in addition to the AC drive so as to drive gear motor 101 in conventional fashion. However, it is noted that in a preferred embodiment of the invention, the power source connected to starter cabinet 112 is a standard 120 volt AC current which is generally available without special installations in studio and other environments in the U.S. and Canada. The relative positioning of starter cabinet 112 can be seen in FIGS. 1 and 2.

Cable retainer 113, which has a generally T-shaped orientation with a thin connection to shaft collar 107 and sleeve 102 and includes twin urethane rollers exerts pressure against aluminum drum 106 to keep the cable 108, which, in a preferred embodiment, is ⅛th inch, 7×19 GAC, again, in a preferred embodiment, having a length of about 25 feet. The cable 108 is wound around each of the drums 106 and held in place so that it reliably and safely winds around drum 106 held in place by the cable retainer 113. Cable retainer 113 is generally in a conventional fashion biased against the cable 108.

Gear motor 101 is supported by mounting plates 120 seen in FIG. 3, which is an end view of portable studio hoist 100. As can be seen, the batten 110 supported on two of the cables 108 hangs from drum 106. Mounting plate 120 supports motor 101 between the two plates 120 as seen best in FIG. 1, and is supported on pipe 103, which extends through an opening in each of the two mounting plates. The positioning of starter cabinet 112 and gear motor 101 is also shown.

Figure 6:
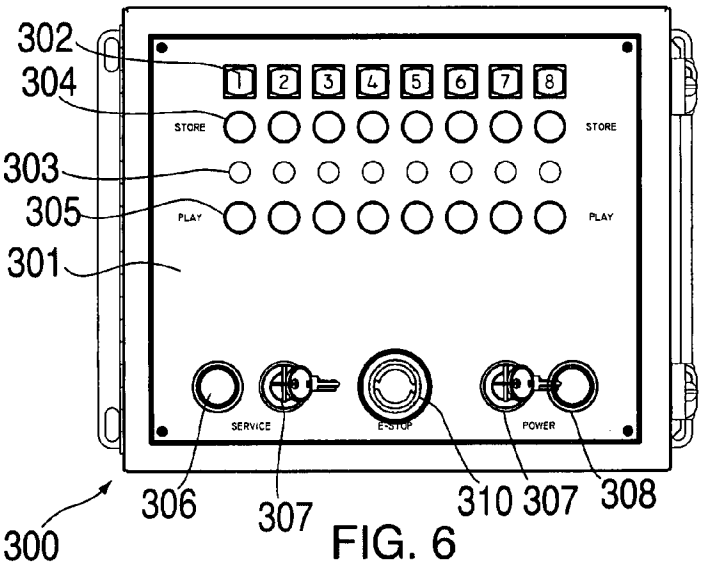
FIG. 6 is a top view of a selector station in accordance with a preferred embodiment of the invention.
Figure 4:
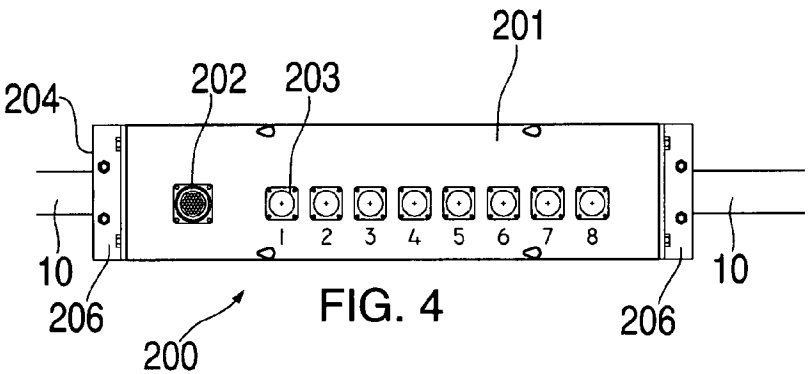
FIG. 4 is a front elevational view of a control hub constructed in accordance with a preferred embodiment of the invention.
Figure 5:
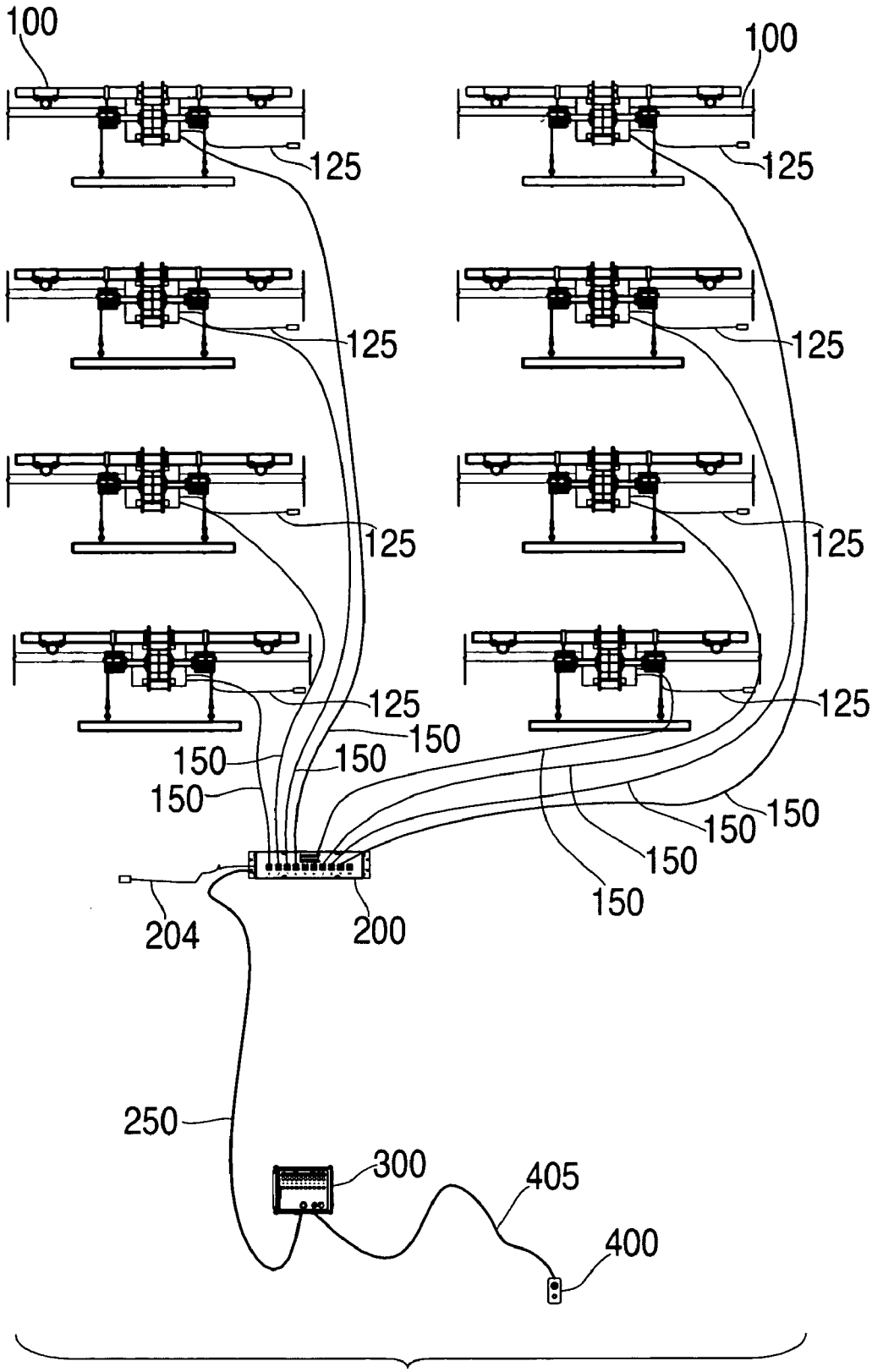
FIG. 5 is a diagrammatic view of a control system for a series of portable studio hoists to be connected together and operated from a single location constructed in accordance with a preferred embodiment of the invention.

Reference is next made to FIG. 4, wherein a hoist control hub 200 constructed in accordance with a preferred embodiment of the invention is depicted. Control hub 200 is a central location for connecting a series of portable studio hoist devices 100 together to allow uniform control from a single location without the need to be proximate the actual portable studio hoist. The control hub 200 includes a casing 201, which includes the various components together with a selector control outlet 202, which is adapted to connect hoist control hub 200 to a selector control station 300 (FIGS. 5, 6). In addition, there are a series of hoist control outlets 203, here numbered 1 through 8, which are designed to receive control cables from each individual portable studio hoist 100. Also, there is a 120 volt power cable 204 to supply power to the hoist control hub which is mounted on pipe 10. In the current preferred embodiment the hoist control hub is shown as being able to receive the control cables from eight separate portable studio hoists 100. However, in other embodiments depending upon the specific needs of the studio or installation, fewer or greater numbers of hoist inputs can be received, such as 6 or 10 or some other amount indicated by the installation's requirements.

Reference is next made to FIG. 6, wherein a hoist selector station 300 constructed in accordance with a preferred embodiment of the invention is depicted. Hoist selector station 300 includes a cabinet 301, enable button/lights 302 which, when depressed, illuminates the numbered button to show that the control of the hoist corresponding to that number is active. In addition, there are a series of toggle switches 303, which allow the hoist to be moved between the store, play and stand-by positions. In the store position, the hoist returns to its storage position pulling the cable 108 in an upward direction and in the play position the hoist moves the cable 108 downward to the operational position of the light. In the middle, stand-by position, no movement is enabled. The stand-by position is used when there is no movement required and is a safety feature. There are series of store position selector lights 304 and a similar series of play position selector lights 305 corresponding to each of the hoists connected to the hoist selector station 300. Also, there are a series of controls at the bottom. There is a key switch 309 for power and a corresponding indicator light 308 which shows when power has been turned on to the hoist selector station 300. Similarly, there is a separate key switch 307 for the service and a corresponding indicator light 306 showing when service has been initiated in hoist selector station 300. There is an emergency stop 310 in the form of a mushroom switch, which when pressed automatically stops any activity by any of the hoists 100 controlled by the hoist selector station 300. Generally, selector station 300 receives its power through the control cable 250 from control hub 200. However, in installations where only one or two hoists 100 are used, the control hub 200 may be excluded from the system, and the control cables from the hoists 100 directly connected to selector station 300. In this configuration, selector station 300 requires a separate power connection to an AC source. Finally, there is a pendant control outlet for connecting the hoist selector station 300 to a separate pendant 400 which is used to control the hoists remotely from the hoist selector station 300.

Figure 7:
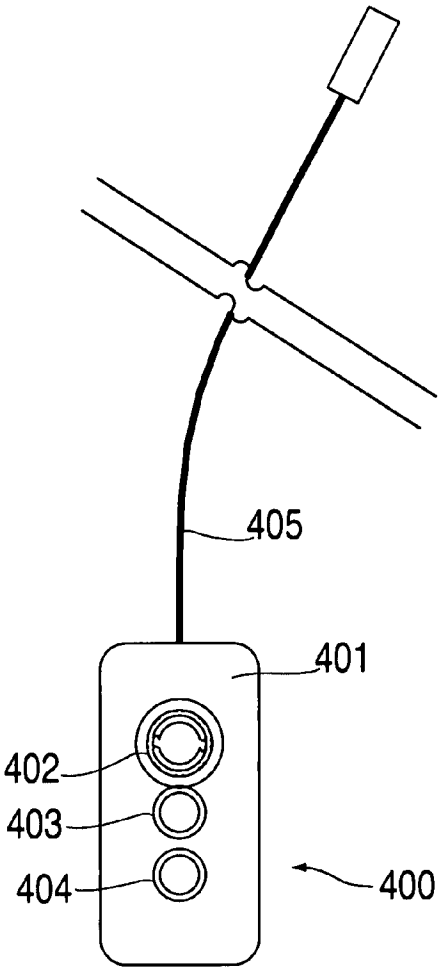
FIG. 7 is a top plan view of an operator pendant constructed in accordance with a preferred embodiment of the invention.

The pendant 400 as shown in FIG. 7, includes a pendant casing 401, with a mushroom emergency stop button 402, a power "On" light 403 and a pushbutton "Run" button to operate the hoist. The pendant is connected to the hoist selector station 300 with a pendant cable 405, which, in a current preferred embodiment, is 50 feet long. This allows the operator to control the operation of the hoists a distance from the hoist selector station 300 and closer to the actual hoist or hoists being operated. However, someone at the hoist selector station must enable the hoist 100 and the direction of movement. The pendant 400 shown in FIG. 7 is a simple pendant intended for operating a single hoist or group of hoists at one time. The operator or someone else would need to select the appropriate hoist or hoists for which movement is enabled on the hoist selector 300 first and then operate the hoists to raise or lower the lighting fixtures or other materials supported by the hoists with the pendant 400.

However, in another preferred embodiment of the invention, pendant 400 can be a more complex arrangement including a touch screen in which the operator can exercise control of the hoists to be selected and operated on the pendant. The hoist selector station 300, for control by the touch screen pendant includes additional circuitry to allow this remote control of the selection. In addition, hoist selector station 300 is shown as connecting to a single hoist control hub 200. In other preferred embodiments, single hoist selector station 300 can be connected to a series of different hoist control hubs 200 in larger installations. Thus, rather than merely controlling 6 or 8 or 10 hoists from a single selector, an entire bank of 24 or 36 or other number of hoists can be connected to two or more control hubs 200 which can be controlled from a single selector station 300 and utilizing a single pendant 400.

FIG. 5 is a view of a representative full system shown in a diagrammatic fashion with a series of eight portable studio hoists 100 connected to the pipe grid 10, 20. Each of the portable studio hoists 100 is also connected to 120 volt power individually through power cords 125. Control cables 150 connect the eight portable studio hoists 100 to control hub 200. Each of these control cables is designed to fit within one of the connectors 203 in control hub 200. Then, control cable 250 goes from selector control outlet 202 to the corresponding outlet on selector control unit 300. In turn, pendant 400 is connected through pendant cable 405 to selector control station 300.

As described above, a series of different control hubs 200 may also be connected to a single selector control outlet 300 depending upon the needs of a particular job. Generally, when a large installation with the capacity for many portable studio hoists is installed in a studio, a series of control hubs 200 are spaced and fixed throughout the pipe grid in a fashion which allows the lighting designers and others to hook up portable studio hoists to a relatively close control hub 200 as the hoists are secured to the pipe grid. Similarly, in large installations, the selector control unit 300 will likely be placed in an electrical enclosure. Such enclosure would be secured by a lock that would prevent unauthorized access to the hoist control system. Again, in larger installations, pendant 400 may also be enhanced to provide additional control at the pendant, rather than at the selector control unit. In large installations, the connections from the selector station 300 to pendant 400 can be enhanced so that connections to various locations around the studio are hard wired, so that the pendant control cable 405 is plugged into connectors which are distributed around the floor, rather than having a long cable which snakes all the way from the selector station 300 to the desired location. In this way the pendant control cable 405 can be made shorter and problems with a long cable avoided.

Figure 8:
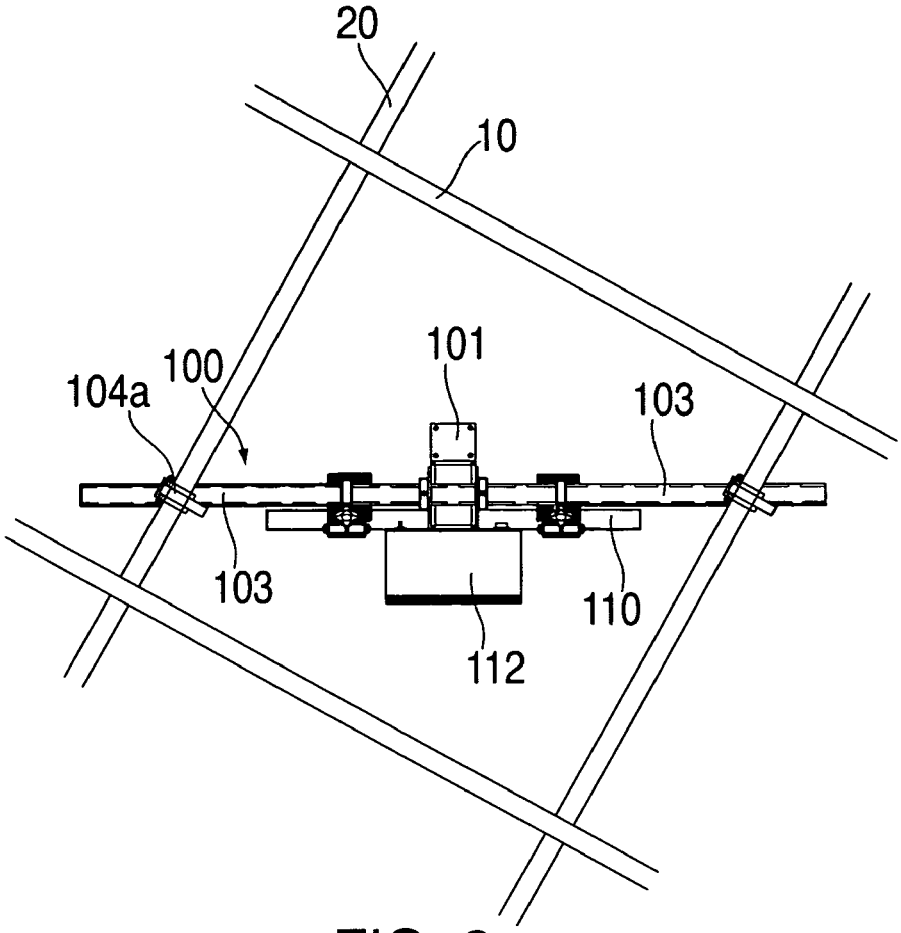
FIG. 8 is a top plan view of a portable studio hoist constructed in accordance with a preferred embodiment of the invention connected at an angle to the pipe grid.
Figure 9:
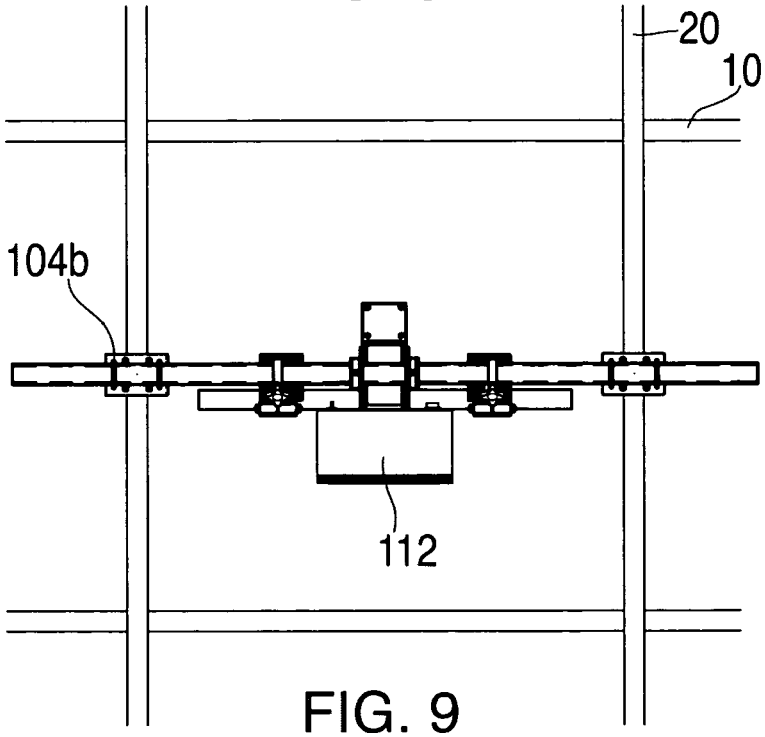
FIG. 9 is a top plan view of a portable studio hoist constructed in accordance with a preferred embodiment of the invention attach orthogonally to the pipe grid.

Reference is next made to FIGS. 8 and 9, wherein the mounting mechanism for portable studio hoist 100 are depicted. In FIG. 8, the hoist is connected so that it is at an angle to the pipe grid as compared to FIG. 9, where it is shown to be orthogonal to the pipe grid to which it is secured and parallel to other pipes on the grid. The connectors 104 shown in FIGS. 1 and 2 are of a type designed to be used in the orthogonal or parallel embodiment of FIG. 9. In addition, depending upon the way in which the pipe grid shown here as 10, 20, is formed, the mounting devices 104 can be designed so as to support the portable studio hoist either above or below the pipes to which they are secured. Also, as shown in FIG. 8, a different type of connector **104*a* is utilized, which allows an angle connection to be made between the pipe 20 to which the portable studio hoist 100 is attached and support bar 103 of portable studio hoist 100. Generally, this sort of connector can be altered in various ways to create connections at different angles. The support bar 103 of studio hoist 100 is long enough to allow stable connections either in the angled orientation as shown in FIG. 8 or the parallel or orthogonal approach of FIG. 9. In FIG. 9, a different type of connector 104***b* from that shown in FIG. 9 or in FIGS. 1 and 2 is present. Many different types of connectors can be used to connect hoist 100 to the pipe grid 10,20 or to other structural elements, such as trusses or other fixed elements so that hoist 100 is secured and sufficiently stable with its own weight and the rated weight of the load to be supported by the hoist 100.

Accordingly, an improved portable studio hoist, which can be easily manipulated and maneuvered by one or two stage hands and then moved around the pipe grid of a television or theatrical studio to raise and lower studio lighting appliances and other relatively moderate weight items without the need for a dedicated hoist with permanent wiring and to provide hierarchical control of the portable studio hoists from a single control panel is provided. Additional configurations of hoists with the use of 120V AC power which can be moved around and organized with decentralized control hubs and a centralized selector station operated by a pendant is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A portable studio hoist, comprising:

a support bar;

motor means, secured to the support bar for driving a dual cable controller;

dual cable controller coupled to the motor means for holding two cables and controlling the taking in and letting out the cables as driven by the motor means;

two cables coupled to the dual cable controller; and a batten, coupled to the two cables; and a connecting element for releasably securing the support bar to a pipe grid or other structural ceiling installations:

whereby the portable studio hoist controls the movement of the batten.

2. The portable studio hoist of claim 1 further including control means for directing the movement of the batten in two opposite directions.

3. The portable studio hoist of claim 2 wherein the control means includes a control hub, a selector control station and a pendant controller.

4. The portable studio hoist of claim 3 wherein each portable studio hoist includes a control cable for coupling to the control hub, and the control hub is adapted to receive a plurality of control cables from a plurality of portable studio hoists.

5. The portable studio hoist of claim 4 wherein the control hub has a connection to a power source and supplies the power to the selector control station and pendant controller.

6. The portable studio hoist of claim 4 where there are more than one control hub each of which is connected to the selector control station.

7. The portable studio hoist of claim 4 wherein there is a selector control cable connecting each control hub to the selector control station and a pendant control cable connecting the selector control station to the pendant controller.

8. The portable studio hoist of claim 7 wherein the selector control cable and pendant control cable carry the AC power from the control hub to the selector control station and pendant controller, respectively.

9. The portable studio hoist of claim 3 wherein the selector control station includes separate switches for enabling the operation of each portable studio hoist connected to the selector control station through the control hub.

10. The portable studio hoist of claim 9 wherein the separate switches enable movement of the batten in two opposite directions.

11. The portable studio hoist of claim 10 wherein the two opposite directions are vertically oriented in the up and down directions.

12. The portable studio hoist of claim 11 wherein the selector control station includes visual indications of the direction of movement for each hoist.

13. The portable studio hoist of claim 3 wherein the pendant controller includes controls for causing the selected hoist or hoists on the selector control station to operate in the selected direction and to stop.

14. The portable studio hoist of claim 3 wherein the pendant controller is further enabled to control the selection and direction of operation of each portable studio hoist connected to it through the control hub and selector control station.

15. The portable studio hoist of claim 1 wherein the portable studio hoist can be releasably secured to the pipe grid or other similar structural element in a variety of orientations.

16. The portable studio hoist of claim 15 where a pair of clamps are used to secure the portable studio hoist to the pipe grid or other similar structural element.

17. A portable studio hoist for controlling the movement of a batten and being releasably secured to a ceiling structure comprising:

a support bar;

motor means, secured to the support bar for driving a cable controller;

a cable controller coupled to the motor means for holding at least one cable and controlling the taking in and letting out the at least one cable as driven by the motor means;

at least one cable coupled to the cable controller; and an adjustable connecting element for releasably securing the support bar to the ceiling structure;

wherein the portable studio hoist is relocatable anywhere on the ceiling structure.

18. The portable studio hoist of claim 17 wherein the portable studio hoist can be releasably secured to the ceiling structure element in a variety of orientations.

19. The portable studio hoist of claim 17 wherein the studio hoist is paired with a single phase AC power source.

20. The portable studio hoist of claim 17 wherein the control means includes a control hub, a selector control station and a pendant controller.

21. The portable studio hoist of claim 20 wherein each portable studio hoist includes a control cable for coupling to the control huh, and the control hub is adapted to receive a plurality of control cables from a plurality of portable studio hoists.

22. The portable studio hoist of claim 20 wherein the control hub has a connection to a power source and supplies the power to the selector control station and pendant controller.

23. The portable studio hoist of claim 20 where there is more than one control hub, each of the control hubs being connected to the selector control station.

* * * * *